US006143193A

United States Patent [19]

Akioka et al.

[11] Patent Number: 6,143,193

[45] Date of Patent: Nov. 7, 2000

[54] RARE EARTH BONDED MAGNET, RARE EARTH MAGNETIC COMPOSITION, AND METHOD FOR MANUFACTURING RARE EARTH BONDED MAGNET

[75] Inventors: Koji Akioka; Hayato Shirai; Ken Ikuma; Mitsuru Takei; Yoshiki Nakamura, all of Suwa, Japan

[73] Assignee: Seiko Epson Corporation, Japan

[21] Appl. No.: 08/744,014

[22] Filed: Nov. 5, 1996

[30] Foreign Application Priority Data

Nov. 6, 1995 [JP] Japan ..... 7-287697
Dec. 25, 1995 [JP] Japan ..... 7-337386

[51] Int. Cl.[7] ..... B22F 3/00

[52] U.S. Cl. ..... 252/62.55; 148/301; 148/302

[58] Field of Search ..... 148/301, 302, 148/303; 256/62.54, 62.55

[56] References Cited

U.S. PATENT DOCUMENTS

| | | | |
|---|---|---|---|
| 2,689,398 | 9/1954 | Gaut et al. . | |
| 4,402,770 | 9/1983 | Koon . | |
| 4,792,367 | 12/1988 | Lee . | |
| 4,844,754 | 7/1989 | Lee . | |
| 4,851,058 | 7/1989 | Croat | 148/302 |
| 4,921,551 | 5/1990 | Vernia et al. . | |

FOREIGN PATENT DOCUMENTS

| | | |
|---|---|---|
| 5-6323 | 6/1984 | Japan . |
| 59/130108 | 1/1986 | Japan . |
| 4-324914 | 11/1992 | Japan . |

OTHER PUBLICATIONS

"Magnetic Properties of Rare–Earth–Iron Intermetallic Compounds", K. Strnat, G. Hoffer, and A.E.Ray, *IEEE Transactions on Magnetics*, vol. MAG–2, No. 3, Sep. 1966.

"New Material for Permanent Magnets on a Base of Nd and Fe", M.Sagawa, S. Fujimura, N. Togawa, H. Yamamoto, and Y. Matsuura, *J. Appl. Phys.* vol. 55, No. 6, Mar. 1984.

"The Metallurgy of the Iron–Neodymium–Boron Permanent Magnet System", H.H.Stadelmaier, N.A.Elmasry, N.C.Liu, and S.F.Cheng, *Materials Letters*, vol. 2, No. 5A, Jun., 1984.

"Thermal and Magnetic Properties of Amorphous $Pr_x(Fe_{0.8}B_{0.2})_{1-x}$", L. Kabacoff, S. Dallek, C. Modzelewski, and W. Krull, *J. Appl. Phys.* vol. 53, No. 3, Mar., 1982.

(List continued on next page.)

*Primary Examiner*—John Sheehan
*Attorney, Agent, or Firm*—Harness, Dickey & Pierce, P.L.C.

[57] ABSTRACT

A rare earth bonded magnet comprising a rare earth magnet powder bonded with a binder resin is manufactured by extrusion or injection molding. A rare earth bonded magnet manufactured by extrusion molding has a rare earth magnet powder content of 78.1 to 83.0 percent by volume. A rare earth bonded magnet manufactured by injection molding has a rare earth magnet powder content of 68.0 to 76.0 percent by volume. Preferably, the rare earth metal powder is at least one of Sm—Co alloys, R—Fe—B alloys wherein R is at least one of rare earth elements including Y, and Sm—Fe—N alloys. Preferably, the thermoplastic resin include polyamide, liquid crystal polymer, and Polyphenylene sulfide. Preferably, the rare earth bonded metal has a void ratio of 2 percent by volume or less. A rare earth bonded magnet is manufactured by kneading a rare earth magnetic composition comprising a rare earth magnet powder and a thermoplastic resin, and by extruding or injecting the mixture after kneading. A rare earth magnetic composition used for extrusion molding contains a rare earth metal powder of 77.6 to 82.5 percent by volume, and a rare earth magnetic composition used for injection molding contains a rare earth metal powder of 67.6 to 75.5 percent by volume. Preferably, such rare earth magnetic compositions further comprise an antioxidant, such as a chelating agent. Thus, a rare earth bonded magnet showing excellent moldability and magnetic properties and high mechanical strength at a minimum binding resin can be obtained.

22 Claims, 1 Drawing Sheet

(A)

OTHER PUBLICATIONS

"Cobalt–Free and Samarium–Free Permanent Magnet Materials Based on an Iron–Rare Earth Boride", H.H. Stadelmaier, N.A. Elmasry, and S. Cheng, *Materials Letters*, vol. 2, No. 2, Oct., 1983.

"Composition Dependence of the Coercive Force and Microstructure of Crystallized Amorphous $(Fe_xB_{1-x})_{0.9}Tb_{0.05}La_{0.05}$ Alloys", N.C.Koon, B.N.Das, and J.A.Geohegan, *IEEE Transactions on Magnetics*, vol. MAG–18, No. 6, Nov., 1982.

"Hot–Pressed Neodymium–Iron–Boron Magnets", R.W.Lee, *Appl. Phys. Lett.*, vol. 46, No. 8, Apr., 1985.

(A)

(B)

(C)

RARE EARTH BONDED MAGNET, RARE EARTH MAGNETIC COMPOSITION, AND METHOD FOR MANUFACTURING RARE EARTH BONDED MAGNET

BACKGROUND OF THE INVENTION

1. Field of the Invention

The present invention relates to a rare earth bonded magnet comprising rare earth magnet powder bonded with a resin, a rare earth magnetic composition which is used for the production of the rare earth bonded magnet, and a method for manufacturing the rare earth bonded magnet using the rare earth magnetic composition.

2. Description of the Related Art

Generally, rare earth bonded magnets of various shapes are molded from compounds of rare earth magnet powders and binder resins or organic binders by pressure molding, such as compaction molding, injection molding, or extrusion molding.

In compaction molding, a bonded magnet is produced by packing a compound into a mold, compacting it to form a green body, and then heating it to harden the thermosetting binder resin. Since the compaction molding method enables molding with a smaller amount of binder resin as compared to other molding methods, the magnetic properties of the resulting magnet are enhanced. However, molding versatility regarding the shape of the magnet is restricted and production efficiency is low.

In injection molding, a bonded magnet is produced by melting a compound and then injecting the flowable melt into a mold of a specified shape. The injection molding method allows high molding versatility regarding the shape of the magnet, and magnets having irregular shapes can be easily produced. However, since injection molding requires a high level of melt fluidity, a large amount of binder resin must be added. Thus, the binder resin content in the magnet is increased which results in lowered magnetic properties.

In extrusion molding, a bonded magnet is produced by melting a compound into an extruder, extruding the compound and cooling the compound from a die of the extruder into a long molded body. The long body is then cut into specified lengths. The extrusion molding method has advantages of both compaction molding and injection molding. That is, in extrusion molding, the shape of the magnet can be varied to some extent by using an appropriate die, and a thin-walled or long magnet can be easily produced. Further, the resulting magnet shows enhanced magnetic properties due to the reduced amount of binder resin because high fluidity of the melt is not required, unlike the injection molding.

Thermosetting resins, such as epoxy resins, have been generally employed as binder resins in compounds, as disclosed in Japanese Patent Publication (Examined) Nos. 56-31841 and 56-44561. The content of the thermosetting resins is low from 0.5 to 4.0 percent by weight due to its high fluidity.

However, there are many points which are not clarified concerning optimum conditions for molding using thermoplastic resins as binder resins, e.g. the effect of the rare earth magnet powder content on the moldability, magnetic properties, and mechanical properties of the bonded magnet.

SUMMARY OF THE INVENTION

It is a first object of the present invention to provide a rare earth bonded magnet, a rare earth magnetic composition for manufacturing the same, and a method for manufacturing the rare earth bonded magnet utilizing the above-mentioned advantages of the extrusion molding process, in which the rare earth bonded magnet contains a minimum amount of thermoplastic resin as a binder resin, and shows excellent moldability and magnetic properties and high mechanical strength.

It is a second object of the present invention to provide a rare earth bonded magnet, a rare earth magnetic composition for manufacturing the same, and a method for manufacturing the rare earth bonded magnet utilizing the above-mentioned advantages of injection molding, in which the rare earth bonded magnet contains a minimum amount of thermoplastic resin as a binder resin, and exhibits excellent moldability, magnetic properties, and high mechanical strength.

To achieve the first object in accordance with the present invention, a rare earth bonded magnet is produced from a rare earth magnetic composition comprising a rare earth magnet powder and a thermoplastic resin by extrusion molding, wherein the content of the rare earth magnet powder in the rare earth bonded magnet ranges from 78.1 to 83 percent by volume.

To achieve the second object in accordance with the present invention, a rare earth bonded magnet is produced from a rare earth magnetic composition comprising a rare earth magnet powder and a thermoplastic resin by injection molding, wherein the content of the rare earth magnet powder in the rare earth bonded magnet ranges from 68 to 76 percent by volume.

The resulting rare earth bonded magnet obtained by extrusion molding or injection molding exhibits excellent moldability and magnetic properties, high mechanical strength, and high corrosion resistance while using a minimum amount of thermoplastic resin.

Preferably, the rare earth bonded magnet has a void ratio of 2 percent by volume or less, in order to further improve mechanical strength and corrosion resistance.

Preferably, the thermoplastic resin used as the binder resin has a melting point of 400° C. or less. Further, it is preferred that the thermoplastic resin is a resin selected from any of polyamide resins, liquid crystal polymers, and polyphenylene sulfide resins.

Preferably, the rare earth magnet powder comprises at least one composition selected from the group consisting of a first composition comprising rare earth elements including Sm as the main ingredient (this language means that either only Sm is included or Sm and one or more other rare earth elements is included in which case Sm has the highest proportion) and transition metals containing Co as the main ingredient (this language means that either only Co is included or Co and one or more transition metals is included in which case Co has the highest proportion); a second composition comprising (1) R wherein R is at least one rare earth element including Y, (2) transition metals including Fe as the main ingredient, and (3) B; and a third composition comprising rare earth elements including Sm as the main ingredient, transition metals including Fe as the main ingredient, and interstitial elements including N as the main ingredient. The magnetic properties of the rare earth bonded magnet is further enhanced by using these rare earth magnet powders.

Preferably, the rare earth magnet powder comprises at least two rare earth magnet powders having different compositions and/or different average particle diameters. By using at least two rare earth magnet powders in combination, the rare earth bonded magnet shows further enhanced magnetic properties as the result of having both advantages. Additionally, when at least two rare earth magnet powders having different average particle diameters are used, smaller magnet powder particles are disposed between larger magnet powder particles by mixing and kneading them thoroughly; thus, the proportion of the magnet powder in the compound can be increased.

Further, when at least two anisotropic magnet powders are mixed, the magnet can be more highly oriented.

It is preferred that the rare earth bonded magnet produced by extrusion molding have a magnetic energy product $(BH)_{max}$ of 8 MGOe (64 kJ/m$^3$) or more when molded under a nonmagnetic field or a magnetic energy product $(BH)_{max}$ of 12 MGOe (96 kJ/m$^3$) or more when molded under a magnetic field.

It is preferred that the rare earth bonded magnet produced by injection molding has a magnetic energy product $(BH)_{max}$ of 6 MGOe (48 kJ/m$^3$) or more when molded under a nonmagnetic field or a magnetic energy product $(BH)_{max}$ of 10 MGOe (80 kJ/m$^3$) or more when molded under a magnetic field.

To achieve the first object in accordance with another aspect of the present invention, a rare earth magnetic composition used for extrusion molding comprises a rare earth magnet powder and a thermoplastic resin, wherein the content of the rare earth magnet powder ranges from 77.6 to 82.5 percent by volume in the rare earth magnetic composition. Thereby, a rare earth bonded magnet showing excellent magnetic properties and high mechanical strength can be easily produced by utilizing the advantages of extrusion molding, i.e., high shape versatility and high productivity.

To achieve the first object in accordance with a further aspect of the present invention, a rare earth magnetic composition used for extrusion molding comprises a rare earth magnet powder, a thermoplastic resin and an antioxidant, wherein the total content of the thermoplastic resin and the antioxidant ranges from 15.0 to 22.4 percent by volume in the rare earth magnetic composition. A rare earth bonded magnet showing a small void ratio, a high mechanical strength, and excellent magnetic properties can be easily produced from such a composition showing high fluidity, excellent moldability, and suppressed oxidation of the magnet powder in the extrusion molding process.

To achieve the second object in accordance with another aspect of the present invention, a rare earth magnetic composition used for injection molding comprising a rare earth magnet powder and a thermoplastic resin, wherein the content of the rare earth magnet powder in the rare earth bonded magnet ranges from 67.6 to 75.5 percent by volume. Accordingly, a rare earth bonded magnet exhibiting excellent magnetic properties and high mechanical strength can be easily produced by utilizing the advantages of the injection molding process, i.e., higher shape versatility.

To achieve the second object in accordance with a further aspect of the present invention, a rare earth magnetic composition used for injection molding comprising a rare earth magnet powder, a thermoplastic resin, and an antioxidant, wherein the total content of the thermoplastic resin and the antioxidant in the rare earth bonded magnet ranges from 24.5 to 32.4 percent by volume. A rare earth bonded magnet showing a small void ratio, a high mechanical strength, and excellent magnetic properties can be easily produced from such a composition exhibiting high fluidity, excellent moldability, and suppressed oxidation of the magnet powder in the extrusion molding process.

Preferably, the rare earth magnetic composition further comprises an antioxidant to reduce oxidation of the rare earth magnet powder and the thermoplastic resin during the production process of the bonded magnet, and to improve kneadability and moldability while using a minimum content of thermoplastic resin. It is preferred that the antioxidant is a chelating agent for inactivating the surface of the magnet powder. The chelating agent has a significantly high antioxidant action.

The content of the antioxidant preferably ranges from 2.0 to 12.0 percent by volume in the rare earth magnetic composition.

It is preferred that the rare earth magnetic composition further comprises at least one of a plasticizer and a lubricant for plasticizing the thermoplastic resin. Since the plasticizer and lubricant improve the fluidity of the rare earth magnetic composition during kneading and molding, the magnetic properties can be enhanced while maintaining fluidity and moldability while reducing the content of thermoplastic resin.

To achieve the first object in accordance with a still further aspect of the present invention, a method for manufacturing a rare earth bonded magnet comprises a step for kneading a rare earth magnetic composition comprising a rare earth magnet powder and a thermoplastic resin, wherein the rare earth magnet powder content ranges from 77.6 to 82.5 percent by volume; and an extrusion molding step to mold the mixture into a specified magnet shape. Thus, a rare earth bonded magnet showing a small amount of void, high mechanical strength and excellent magnetic properties can be easily produced while utilizing the advantages of the extrusion molding process.

To achieve the second object in accordance with another aspect of the present invention, a method for manufacturing a rare earth bonded magnet comprises a step for kneading a rare earth magnetic composition comprising a rare earth magnet powder and a thermoplastic resin, wherein the rare earth magnet powder content ranges from 67.6 to 75.5 percent by volume; and an injection molding step to mold the mixture into a specified magnet shape. Thus, a rare earth bonded magnet showing a small amount of void, high mechanical strength and excellent magnetic properties can be easily produced while utilizing the advantages of the injection molding process.

It is preferred that compositions for the rare earth bonded magnet used in such methods further comprise an antioxidant, and more preferably at least one of a plasticizer and a lubricant to achieve the properties set forth above. The antioxidant content preferably ranges from 2.0 to 12.0 percent by volume in the rare earth magnetic composition.

The rare earth magnetic composition is preferably kneaded at a temperature higher than the thermal deformation temperature or softening temperature of the thermoplastic resin selected for use in the method for manufacturing the rare earth bonded magnet in accordance with the present invention. Since kneading efficiency improves by kneading at such a temperature, homogeneous kneading can be achieved within a shorter time and the void ratio in the resulting rare earth bonded magnet is further reduced.

These and other objects, features, and advantages of the invention will become more apparent with reference to the drawings and description as set forth below.

DESCRIPTION OF THE PREFERRED EMBODIMENTS

Figure 1:
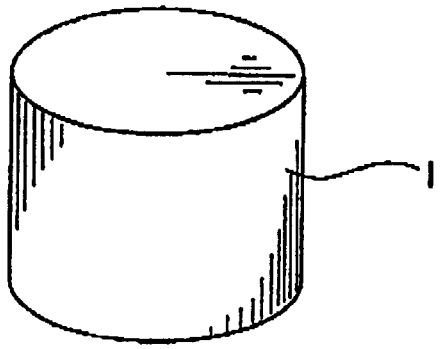
FIG. 1 is an isometric view of an embodiment of a rare earth bonded magnet in accordance with the present invention.
Figure 1:
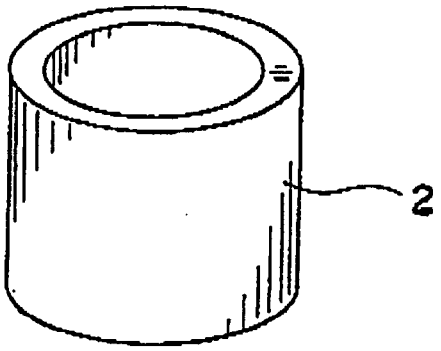
Figure 1:
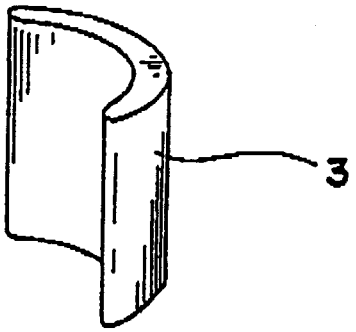

A rare earth bonded magnet, a rare earth magnetic composition, and a method for manufacturing the rare earth bonded magnet in accordance with the present invention will now be described in detail with reference to the drawings. It should be understood that the description herein is intended for both extrusion molding and injection molding unless a specific molding method is specified.

Examples of the rare earth bonded magnet in accordance with the present invention include a rod shaped bonded magnet 1 shown in FIG. 1A, a cylindrical bonded magnet 2 shown in FIG. 1B, and an arch shaped bonded magnet 3 shown in FIG. 1C.

The rare earth bonded magnets 1, 2, 3 comprise a rare earth magnet powder and a thermoplastic resin as set forth below, and may also comprise an antioxidant.

1. Rare Earth Magnet Powder

A rare earth magnet powder should preferably comprise an alloy containing at least one rare earth element and at least one transition metal, and particularly preferable are the following alloys [1] to [5]:

[1] An alloy comprising, as main ingredients, rare earth elements mainly including Sm (this language means that either only Sm is included or Sm and one more rare earth elements in which case Sm has the highest proportion) and transition metals mainly including Co (hereinafter referred to as "Sm—Co alloy").

[2] An alloy comprising, as main ingredients, R (R represents at least one of rare earth elements including Y), transition metals mainly including Fe, and B (hereinafter referred to as "R—Fe—B alloy").

[3] An alloy comprising, as main ingredients, rare earth elements mainly including Sm, transition metals mainly including Fe, and interstitial elements mainly including N (hereinafter referred to as "Sm—Fe—N alloy").

[4] An alloy comprising, as main ingredients, R (R represent at least one of rare earth elements including Y) and at least one transition metal such as Fe, and having a magnetic phase on nanometer level (nanocrystalline magnet).

[5] An alloy comprising a mixture of at least two of the foregoing compositions [1] to [4].

With this composition, the resultant magnet can have advantages of all the kinds of magnet powder in the mixture, particularly in magnetic properties, thus making it possible to easily obtain more excellent magnetic properties. Especially when mixing two or more kinds of anisotropic magnetic powder, the resultant magnet has an improved degree of alignment.

Typical examples of Sm—Co alloy include $SmCo_5$, $Sm_2TM_{17}$, wherein TM represents a transition metal.

Typical examples of the R—Fe—B alloy include Nd—Fe—B alloy, Pr—Fe—B alloy, Nd—Pr—Fe—B alloy, Ce—Nd—Fe—B alloy, Ce—Pr—Nd—Fe—B alloy, and modified alloys thereof in which Fe is partly substituted with other transition metals, such as Ni and Co.

A typical example of the Sm—Fe—N alloy is $Sm_2Fe_{17}N_3$ prepared by nitriding a $Sm_2Fe_{17}$ alloy.

Examples of rare earth elements in the magnet powder include Y, La, Ce, Pr, Nd, Pm, Sm, Eu, Gd, Tb, Dy, Ho, Er, Tm, Yb, Lu, and Mischmetal. The magnet powder may include one or more of these elements. Examples of transition metals include Fe, Co and Ni. The magnet powder may include one or more of these metals. The magnet powder may further comprise B, Al, Mo, Cu, Ga, Si, Ti, Ta, Zr, Hf, Ag and Zn, if necessary, to improve magnetic properties.

Although the average particle diameter of the magnet powder is not restricted, it ranges preferably from approximately 0.5 to 50 $\mu$m and more preferably from approximately 1 to 30 $\mu$m. The particle diameter may be determined with a F.S.S.S. (Fischer Sub-Sieve Sizer), for example.

It is preferred that the magnet powder has a relatively wide particle diameter distribution to achieve excellent moldability with a small amount of binder resin during injection molding or extrusion molding. In this case, the ratio of voids-to-total volume in the resulting bonded magnet can be decreased.

In the mixture [5] set forth above, each magnet powder to be mixed may have a different average particle diameter. When at least two kinds of magnetic powders having different average particle diameters are used, magnetic powders having smaller particle diameters can be easily disposed between magnetic powders having larger particle diameters after thorough mixing and kneading. Thus, the packing rate of the magnet powder can be raised in the compound, resulting in improved magnetic properties.

The magnet powder can be produced by any conventional methods, e.g. milling, followed by screening if necessary, of an alloy ingot prepared by melting and casting, into a proper particle size range; and milling, followed by screening if necessary, of a melt spun ribbon comprising a fine polycrystalline texture which is made with a melt spinning apparatus for the amorphous alloy production.

The preferable proportion of magnetic powder in the bonded magnet varies according to the molding method.

In the rare earth bonded magnet manufactured by extrusion molding, the content of the rare earth magnet powder ranges from approximately 78.1 to 83 percent by volume, preferably from approximately 79.5 to 83 percent by volume, and more preferably from approximately 81 to 83 percent by volume. Extremely low amounts of the rare earth magnet powder sacrifices magnetic properties, especially magnetic energy product, and excessive amounts cause decreased fluidity during extrusion molding, which results in difficult or impossible molding because of a relatively low content of binder resin.

In the rare earth bonded magnet manufactured by injection molding, the content of the rare earth magnet powder ranges from approximately 68 to 76 percent by volume, preferably from approximately 70 to 76 percent by volume, and more preferably from approximately 72 to 76 percent by volume. Extremely low amounts of the rare earth magnet powder sacrifices magnetic properties, especially magnetic energy product, and excessive amounts cause decreased fluidity during injection molding, which results in difficult or impossible molding because of a relatively low content of binder resin.

2. Binder Resin

Binder resins used in accordance with the present invention are thermoplastic resins. When thermosetting resins, e.g. epoxy resins, which are conventional binder resins, are used, the fluidity in the extrusion or injection molding process is poor, resulting in poor moldability, an increased void ratio in the magnet, low mechanical strength, and decreased corrosion resistance. In contrast, thermoplastic resins do not cause such problems.

Examples of usable thermoplastic resins include polyamides, e.g. nylon 6, nylon 12, nylon 66, nylon 610, nylon 612, nylon 11, nylon 12, nylon 6–12, and nylon 6–66; liquid crystal polymers, e.g. thermoplastic polyimides, and aromatic polyesters; polyphenylene oxides; polyphenylene sulfides; polyolefins, e.g. polyethylenes, and polypropylenes; modified polyolefins; polycarbonates; polymethyl methacrylate; polyethers; polyether ketones; polyether imides; polyacetals; and copolymers, mixtures, and polymer alloys containing the above as the main ingredient. These resins may be used alone or in combination.

Among them, thermoplastic resins containing polyamides, liquid crystal polymers, and/or polyphenylene sulfides, as main ingredients, are preferably used, because they have excellent kneadability with the magnet powder, excellent moldability, and high mechanical strength. In particular, polyamides significantly improve moldability, and liquid polymers and polyphenylene sulfide can improve heat resistance.

A most suitable thermoplastic resin can be selected freely from the above resins by determining the kind of resin, and/or by copolymerizing the resin, for example, in consideration of moldability, heat resistance, or mechanical strength.

Thermoplastic resins used preferably have a melting point of 400° C. or less, and more preferably, 300° C. or less. When thermoplastic resins having a melting point over 400° C. are used, the magnet powder is readily oxidized because of the higher molding temperature.

It is preferred that thermoplastic resins used have an average molecular weight ranging from 10,000 to 60,000, and more preferably, from 12,000 to 30,000.

3. Antioxidant

The antioxidant is an additive added to the composition in accordance with the present invention to prevent the oxidation, deterioration, or modification of the rare earth magnet powder, and the oxidation of the binder resin, which may be caused by the catalytic action of the metal component in the rare earth magnet powder, during kneading of the rare earth magnetic composition. The addition of the antioxidant results in the following advantages. First, the antioxidant prevents the rare earth magnet powder and the binder resin from oxidizing. Thus, excellent wettability between the rare earth magnet powder surface and binder resin is maintained, resulting in improved kneadability between the rare earth magnet powder and the binder resin. Second, since the antioxidant can prevent the rare earth magnet powder from oxidizing, it improves magnetic properties of the magnet, and thermal stability of the rare earth magnetic composition during kneading and molding, and excellent moldability can be achieved with a smaller amount of binder resin.

Since the antioxidant is evaporated or decomposed during the kneading and molding steps of the rare earth magnetic composition, the manufactured rare earth bonded magnet contains a part of the antioxidant as the residue. Thus, the antioxidant content in the rare earth bonded magnet generally ranges from approximately 10 to 90 percent, and in particular from 20 to 80 percent of the amount added to the rare earth magnetic composition. The antioxidant also improves the corrosion resistance of the resulting magnet, in addition to the anti-oxidant action to the rare earth magnet powder and binder resin in the manufacturing process.

Any conventional antioxidants which can prevent or reduce the oxidation of the rare earth magnet powder and the binder resin can be used. Examples of preferred antioxidants include chelating agents, such as amines, amino acids, nitrocarboxylic acids, hydrazines, cyanides, and sulfides, which inactivate the surface of the rare earth magnet powder. Such chelating agents have a significantly high antioxidant action. The kind and content of the antioxidant are not limited to the above.

The rare earth bonded magnet may further comprise a plasticizer, e.g. stearate salts, and fatty acids, for plasticizing the binder resin; a lubricant, e.g. silicone oils, waxes, fatty acids, and inorganic lubricants such as alumina, silica and titania; and other additives, such as a molding activator. When at least one of a plasticizer and lubricant is added, the fluidity further improves during kneading of the rare earth magnetic composition and molding of the rare earth bonded magnet.

It is preferred that the void ratio of the rare earth bonded magnet in accordance with the present invention is 2 percent by volume or less, and more preferably, 1.5 percent by volume or less. An excessive void ratio may cause a decrease in mechanical strength and corrosion resistance, depending on the composition and content of the thermoplastic resin, the composition and particle size of the magnet powder, and the like.

Both isotropic and anisotropic rare earth bonded magnets in accordance with the present invention show excellent magnetic properties, due to the composition of the magnet powder and a high content of the magnet powder.

The rare earth bonded magnet manufactured by extrusion molding has a magnetic energy product $(BH)_{max}$ of 8 MGOe (64 kJ/m$^3$) or more, and in particular, 9.5 MGOe (76 kJ/m$^3$) or more, when it is molded under a nonmagnetic field, or a magnetic energy product $(BH)_{max}$ of 12 MGOe (96 kJ/m$^3$) or more, and in particular, 14 MGOe (112 kJ/m$^3$) or more, when it is molded under a magnetic field.

The shape and size of the rare earth bonded magnet in accordance with the present invention are not limited. For example, the rare earth bonded magnet can have a variety of shapes, such as hollow or solid prismatic or plate shape, as well as a rod, cylindrical, or arch shape as shown in FIG. 1. The size can be varied from a large size to an ultra small size.

Next, the rare earth magnetic composition will be described.

The rare earth magnetic composition in accordance with the present invention comprises the rare earth magnet powder and the thermoplastic resin which are set forth above. Preferably, the rare earth magnetic composition further comprises the antioxidant set forth above.

The rare earth magnet powder content in the rare earth magnetic composition is determined in consideration of magnetic properties of the resulting rare earth bonded magnet and fluidity of the melt composition during molding.

In the rare earth magnetic composition used for extrusion molding, the content of the rare earth magnet powder in the composition ranges preferably from approximately 77.6 to 82.5 percent by volume, and more preferably from approximately 79 to 82.5 percent by volume. When the rare earth magnet powder content is extremely low, magnetic properties and particularly magnetic energy product are not improved, whereas at an excessive rare earth magnet powder content, fluidity decreases during extrusion molding, resulting in difficult or impossible moldability due to a relatively low binder resin content.

In the rare earth magnetic composition used for injection molding, the content of the rare earth magnet powder in the composition ranges preferably from approximately 67.6 to 75.5 percent by volume, and more preferably from approximately 69.5 to 75.5 percent by volume. When the rare earth magnet powder content is extremely low, magnetic properties and particularly magnetic energy product are not improved, whereas at an excessive rare earth magnet powder content, fluidity decreases during injection molding, resulting in difficult or impossible moldability due to a relatively low binder resin content.

The contents of the thermoplastic resin and antioxidant in the rare earth magnetic composition may vary with the kind and composition of the resin and antioxidant, molding conditions such as temperature and pressure, and the shape and size of the molded body. It is preferred that the thermoplastic resin is added in an amount as small as possible as long as kneading and molding can be carried out in order to enhance magnetic properties of the resulting rare earth bonded magnet.

The antioxidant content in the rare earth magnetic composition ranges preferably from approximately 2.0 to 12.0 percent by volume, and more preferably from approximately 3.0 to 10.0 percent by volume. Preferably, the antioxidant is added in an amount of 10 to 150 percent of the binding resin added, and more preferably 25 to 90 percent. However, in the scope of the present invention, the antioxidant content of less than the lower limit set forth above is allowable, and the addition of the antioxidant is not always essential.

When the thermoplastic resin content in the rare earth magnetic composition is extremely low, the viscosity of the mixture of the rare earth magnetic composition increases, resulting in increased torque during kneading and accelerated oxidation of the magnet powder due to heat generation. Thus, the oxidation of the magnet powder cannot be suppressed at a low antioxidant content. Further, since the moldability is relatively poor due to the increased viscosity of the mixture (resin melt), the magnet having a small void ratio and a high mechanical strength cannot be obtained. On the other hand, when the thermoplastic resin content is excessively high, the magnetic properties decrease, although moldability improves.

When the antioxidant content in the rare earth magnetic composition is extremely low, the antioxidant action is insufficient at a high magnet powder content to suppress the oxidation of the magnet powder. On the other hand, an excessive antioxidant content may decrease the mechanical strength of the molded body due to the relatively low resin content.

As set forth above, the antioxidant content can be reduced when a relatively high amount of thermoplastic resin is added, whereas the antioxidant content must increased at a lower thermoplastic resin content.

When it is used for extrusion molding, it is preferred that the total content of the thermoplastic resin and antioxidant ranges from 15.0 to 22.4 percent by volume, more preferably from 15.0 to 20.5 percent by volume, and most preferably from 15.0 to 18.5 percent by volume of the rare earth magnetic composition. When it is used for injection molding, it is preferred that the total content of the thermoplastic resin and antioxidant ranges from 24.5 to 32.4 percent by volume, more preferably from 24.5 to 30.5 percent by volume, and most preferably from 24.5 to 28.0 percent by volume of the rare earth magnetic composition. In such ranges, fluidity, moldability, and the antioxidant effect of the magnet powder improve, resulting in a magnet having a small void ratio, a high mechanical strength, and excellent magnetic properties, in both extrusion and injection molding.

The rare earth magnetic composition may contain various additives set forth above, if necessary.

The plasticizer and lubricant are preferably added to improve fluidity during molding and to achieve excellent properties with a smaller binder resin content. Preferably, the plasticizer content ranges from 0.1 to 2.0 percent by volume and the lubricant content ranges from 0.2 to 2.5 percent by volume, to maximize the advantages gained by the addition of such additives.

The rare earth magnetic composition can have various forms, for example, a mixture of a rare earth magnet powder and a thermoplastic resin, a mixture of the above with other additives such as an antioxidant, as-kneaded mixtures thereof, and pelletized mixture thereof having a pellet size of 1 to 12 mm. When these mixtures or pellets thereof are used, moldability further improves in extruding and injection molding. Moreover, the use of pellets improves handling.

The mixtures set forth above can be kneaded with a roll mill, kneader, or twin-screw extruder, for example.

The kneading temperature can be determined depending on the composition and characteristics of the thermoplastic resin used, and preferably is a temperature higher than the thermal deformation temperature or softening temperature (softening point or glass transition temperature). When using a thermoplastic resin having a relatively low melting point, the kneading temperature is preferably a temperature near or higher than the melting point of the thermoplastic resin.

When kneading is carried out at such a temperature, the mixture can be homogeneously kneaded at a shorter time period due to the enhances kneading efficiency. Further, the void ratio of the rare earth bonded magnet decreases because the thermoplastic resin surrounds the rare earth magnet powder particles by kneading the mixture at a state where the viscosity of the thermoplastic resin decreases.

Preferred examples for manufacturing the rare earth bonded magnet in accordance with the present invention will now be described. The rare earth bonded magnet in accordance with the present invention can be manufactured using the rare earth magnetic composition set forth above by extrusion or injection molding as set forth below.

[I] Extrusion Molding

A rare earth magnetic composition (mixture) comprising a rare earth magnet powder, a thermoplastic resin and an optional antioxidant is kneaded thoroughly with a kneading machine as set forth above to prepare the kneaded mixture. The kneading temperature can be set to 150 to 350° C., for example, in consideration of parameters set forth above. The kneaded mixture may be pelletized before use.

The rare earth magnetic composition after kneading is melted in a cylinder in an extruder by heating it up to a temperature higher than the melting point of the thermoplastic resin, and is extruded from an extruding die under a magnetic field (for example, under an alignment field of 10 to 20 kOe (8 to 16 kA/cm)) or a nonmagnetic field. Preferably, the temperature of the material in the cylinder ranges from approximately 20 to 330° C., the extruding speed ranges from approximately 0.1 to 10 mm/sec, and the temperature of the mold ranges from approximately 200 to 350° C.

The molded body is cooled to solidify while being extruded from the die, for example. The long molded body is then cut into a rare earth bonded magnet having a specified shape and size.

The cross-section shape of the rare earth bonded magnet is determined by the shape of the extruding die (inside die and outside die), and a rare earth bonded magnet having a thin walled or irregular shape can be easily manufactured. Further, a long rare earth bonded magnet can be manufactured by adjusting the cutting length.

A rare earth bonded magnet suitable for mass production can be continuously produced with high shape versatility, excellent fluidity and moldability even at a smaller resin content, and with high dimensional precision.

[II] Injection Molding

A rare earth magnetic composition (mixture) comprising a rare earth magnet powder, a thermoplastic resin and an optional antioxidant is kneaded thoroughly with a kneading machine as set forth above to prepare the kneaded mixture. The kneading temperature can be set to 150 to 350° C., for example, in consideration of parameters set forth above. The kneaded mixture may be pelletized before use.

The rare earth magnetic composition after kneading is melted into a cylinder in a injection molding machine by heating to a temperature higher than the melting point of the thermoplastic resin, and injecting into a mold under a magnetic field or a nonmagnetic field (for example, an alignment field of 6 to 18 kOe (5 to 14 kA/cm)). It is preferred that the temperature in the cylinder ranges from approximately 220 to 350° C., the injection pressure ranges from approximately 30 to 100 kgf/cm$^2$ (3 to 10 MPa), and the mold temperature ranges from approximately 70 to 100° C.

The molded body is cooled to solidify to obtain a rare earth bonded magnet having a specified shape and size. Preferably the molded body is cooled for approximately 5 to 30 seconds.

The shape of the rare earth bonded magnet is determined by the injection mold, and a rare earth bonded magnet having a thin wall thickness or irregular shape can be readily manufactured by selecting the shape of the mold.

A rare earth bonded magnet suitable for mass production can be continuously produced with a short molding cycle, higher shape versatility than that in extrusion molding, excellent fluidity and moldability even at a smaller resin content, and with high dimensional precision.

Mixing conditions and molding conditions other than those set forth above can be employed in the method for manufacturing the rare earth bonded magnet in accordance with the present invention.

EXAMPLES

The present invention will now be described with reference to Examples.

Examples 1 to 13 and Comparative Examples 1 and 2

Seven kinds of rare earth magnet powders, (1) through (7), each having a composition set forth below, three thermoplastic binder resins A, B and C, N,N-diphenyl oxamide as an antioxidant or chelating agent, a metal soap as a plasticizer and a fatty acid as a lubricant were mixed according to the formulations set forth in Table 1.

Each mixture was kneaded with a screw kneader under the conditions set forth in Tables 2 and 3, and the resulting rare earth magnetic composition (compound) was subjected to a molding process under the conditions set forth in Tables 2 and 3 to obtain a rare earth bonded magnet. The shape, size, composition, visual appearance, and various properties of each resulting magnet will be summarized in Tables 4 through 6.

Rare Earth Magnet Powders (1) Quenched $Nd_{12}Fe_{82}B_6$ powder (average diameter: 18 μm)

(2) Quenched $Nd_8Pr_4Fe_{82}B_6$ powder (average diameter: 17 μm)

(3) Quenched $Nd_{12}Fe_{78}Co_4B_6$ powder (average diameter: 19 μm)

(4) $Sm(Co_{0.604}Cu_{0.06}Fe_{0.32}Zr_{0.016})_{8.3}$ powder (average diameter: 21 μm)

(5) $Sm_2Fe_{17}N_3$ powder (average diameter: 2 μm)

(6) Anisotropic $Nd_{13}Fe_{69}Co_{11}B_6Ga_1$ powder by H.D.D.R. method (average diameter: 28 μm)

(7) Nano-crystalline $Nd_{5.5}Fe_{66}B_{18.5}Co_5Cr_5$ powder (average diameter: 15 μm)

Thermoplastic Binder Resins

A. Polyamide (nylon 12), melting point: 175° C.

B. Liquid crystal polymer, melting point: 180° C.

C. Polyphenylene sulfide (PPS), melting point: 280° C.

Each mechanical strength in Tables 4 through 6 was determined by a shearing-by-punching method using a test piece of 15 mm in outside diameter and 3 mm in height, which was molded by an extrusion molding process under the conditions set forth in Tables 2 and 3, under a nonmagnetic field.

Each corrosion resistance in Tables 4 through 6 was evaluated by accelerated test of the resulting rare earth bonded magnet at 80° C. and 90% RH. Results were classified into four grades, i.e., ◎ (excellent), ○ (good), Δ (average), and X (poor), based on the time period that rust was firstly observed.

Comparative Example 3

A rare earth bonded magnet was prepared as follows: The magnet powder (1) set forth above and an epoxy resin as a thermosetting resin were mixed in amounts as shown in Table 1, the mixture was kneaded at room temperature, the resulting compound was subjected to a compaction molding process under a condition shown in Table 3 set forth below, and the molded body was heated at 150° C. for 1 hour to cure the thermosetting resin.

The shape, size, composition, visual appearance, and various properties of resulting magnet are shown in Table 6. The mechanical strength shown in Table 6 was evaluated by a shearing-by-punching method of a test piece having an outer diameter of 15 mm and a height of 3 mm, which was obtained by compaction molding under conditions shown in Table 6 under a nonmagnetic field. The corrosion resistance was evaluated by the method identical to the above.

TABLE 1

| | Composition [vol %] | |
|---|---|---|
| Example 1 | Magnetic powder (1): | 77.6 |
| | Polyamide: | 22.4 |
| Example 2 | Magnetic powder (2): | 79 |
| | Polyamide: | 16 |
| | Antioxidant: | 5.0 |
| Example 3 | Magnetic powder (3): | 80.5 |
| | Polyamide: | 12.3 |
| | Antioxidant: | 6.0 |
| | Lubricant: | 1.2 |
| Example 4 | Magnetic powder (3): | 82.5 |
| | Polyamide: | 9.0 |
| | Antioxidant: | 6.5 |
| | Lubricant: | 1.5 |
| | Plasticizer: | 0.5 |
| Example 5 | Magnetic powder (4): | 82.5 |
| | Polyamide: | 11.5 |
| | Antioxidant: | 4.5 |
| | Lubricant: | 1.2 |
| | Plasticizer: | 0.3 |
| Example 6 | Magnetic powder (5): | 81 |
| | Polyamide: | 10 |
| | Antioxidant: | 6.5 |
| | Lubricant: | 1.8 |
| | Plasticizer: | 0.7 |
| Example 7 | Magnetic powder (4): | 60 |
| | Magnetic powder (5): | 22.5 |
| | Polyamide: | 10.3 |
| | Antioxidant: | 5.5 |
| | Lubricant: | 1.2 |
| | Plasticizer: | 0.5 |
| Example 8 | Magnetic powder (2): | 80 |
| | Liquid crystal polymer: | 12.5 |
| | Antioxidant: | 6.0 |
| | Lubricant: | 1.5 |

TABLE 1-continued

| Composition [vol %] | | |
|---|---|---|
| Example 9 | Magnetic powder (4): | 40 |
| | Magnetic powder (6): | 40 |
| | Polyamide: | 12.5 |
| | Antioxidant: | 6.1 |
| | Lubricant: | 1.4 |
| Example 10 | Magnetic powder (3): | 81.5 |
| | PPS | 9.7 |
| | Antioxidant: | 7.0 |
| | Lubricant: | 1.4 |
| | Plasticizer: | 0.4 |
| Example 11 | Magnetic powder (4): | 40 |
| | Magnetic powder (5): | 20 |
| | Magnetic powder (6): | 20 |
| | PPS | 12.1 |
| | Antioxidant: | 6.5 |
| | Lubricant: | 1.4 |

TABLE 1-continued

| Composition [vol %] | | |
|---|---|---|
| Example 12 | Magnetic powder (4): | 42 |
| | Magnetic powder (5): | 20 |
| | Magnetic powder (6): | 20 |
| | Liquid crystal polymer: | 10 |
| | Antioxidant: | 6.4 |
| | Lubricant: | 1.6 |
| Example 13 | Magnetic powder (1): | 60 |
| | Magnetic powder (7): | 22.5 |
| | Polyamide: | 9.0 |
| | Antioxidant: | 6.5 |
| | Lubricant: | 1.5 |
| | Plasticizer: | 0.5 |
| Comparative Example 1 | Magnetic powder (1): | 84 |
| | Polyamide: | 16 |
| Comparative Example 2 | Magnetic powder (1): | 84 |
| | Polyamide: | 10 |
| | Antioxidant: | 5 |
| | Lubricant: | 1.0 |
| Comparative Example 3 | Magnetic powder (1): | 80 |
| | Epoxy resin: | 20 |

TABLE 2

| | Kneading Conditions | | Molding Conditions | | | |
|---|---|---|---|---|---|---|
| | Temperature [° C.] | Length* [cm] | Method | Material Temperature in Cylinder [° C.] | Die Temperature [° C.] | Alignment Field [kOe] |
| Example 1 | 230 | 25 | Extrusion | 240 | 250 | Under nonmagnetic field |
| Example 2 | 230 | 25 | Extrusion | 240 | 250 | Under nonmagnetic field |
| Example 3 | 230 | 30 | Extrusion | 240 | 250 | Under nonmagnetic field |
| Example 4 | 230 | 35 | Extrusion | 240 | 250 | Under nonmagnetic field |
| Example 5 | 230 | 35 | Extrusion | 240 | 250 | 15 |
| Example 6 | 230 | 30 | Extrusion | 240 | 250 | 15 |
| Example 7 | 230 | 35 | Extrusion | 240 | 250 | 15 |
| Example 8 | 250 | 35 | Extrusion | 270 | 275 | Under nonmagnetic field |

To be continued on Table 3*

: This value represents the intensity of kneading. (Total length of kneading disk sections in the kneader.)

TABLE 3

| | Kneading Conditions | | Molding Conditions | | | |
|---|---|---|---|---|---|---|
| | Temperature [° C.] | Length* [cm] | Method | Material Temperature in Cylinder [° C.] | Die Temperature [° C.] | Alignment Field [kOe] |
| Example 9 | 230 | 30 | Extrusion | 240 | 250 | 18 |
| Example 10 | 300 | 35 | Extrusion | 320 | 320 | Under nonmagnetic field |
| Example 11 | 300 | 35 | Extrusion | 320 | 320 | 18 |
| Example 12 | 250 | 30 | Extrusion | 270 | 275 | 18 |
| Example 13 | 230 | 35 | Extrusion | 240 | 250 | Under nonmagnetic field |
| Comparative Example 1 | 230 | 40 | Extrusion | 240 | — | Under nonmagnetic field |
| Comparative Example 2 | 230 | 40 | Extrusion | 240 | 250 | Under nonmagnetic field |
| Comparative Example 3 | Room temperature | — | Compaction | Pressure: 7 t/cm$^2$ (69 kN/cm$^2$) | Room temperature | Under nonmagnetic field |

*: This value represents intensity of kneading. (Total length of kneading disk sections in the kneader.)

TABLE 4

| | Magnet Shape | Magnet Size [mm] | | Magnet Composition [vol %] | | Magnetic Energy Product (BH)max [MGOe] | Density ρ [g/cm$^3$] | Void [vol %] | Appearance | Mechanical Strength [kgf/mm$^2$] | Corrosion Resistance |
|---|---|---|---|---|---|---|---|---|---|---|---|
| Example 1 | Hollow cylinder | Outer diameter: | 18 | Magnetic powder (1): | 78.1 | 9.2 | 6.06 | 1.1 | Good | 9.4 | ○ |
| | | Wall thickness: | 0.7 | Polyamide: | 19.9 | | | | | | |
| | | Length: | 8 | | | | | | | | |
| Example 2 | Hollow cylinder | Outer diameter: | 18 | Magnetic powder (2): | 79.5 | 11.0 | 6.22 | 1.0 | Good | 8.8 | ⊙ |
| | | Wall thickness: | 0.7 | Polyamide: | 15.5 | | | | | | |
| | | Length: | 8 | Antioxidant: | about 4 | | | | | | |
| Example 3 | Hollow cylinder | Outer diameter: | 18 | Magnetic powder (3): | 81 | 12.6 | 6.32 | 1.4 | Good | 7.6 | ⊙ |
| | | Wall thickness: | 0.7 | Polyamide: | 12 | | | | | | |
| | | Length: | 8 | Antioxidant: | about 5 | | | | | | |
| | | | | Lubricant: | trace | | | | | | |
| Example 4 | Hollow cylinder | Outer diameter: | 18 | Magnetic powder (3): | 83 | 14.0 | 6.51 | 1.2 | Good | 6.1 | ○ |
| | | Wall thickness: | 0.7 | Polyamide: | 8.5 | | | | | | |
| | | Length: | 8 | Antioxidant: | about 5 | | | | | | |
| | | | | Lubricant.Plasticizer: | trace | | | | | | |
| Example 5 | Plate | Width: | 8 | Magnetic powder (4): | 83 | 18.6 | 7.24 | 1.0 | Good | 10.0 | ⊙ |
| | | Thickness: | 1 | Polyamide: | 12 | | | | | | |
| | | Length: | 10 | Antioxidant: | about 4 | | | | | | |
| | | | | Lubricant.Plasticizer: | trace | | | | | | |

To be continued on Table 5

TABLE 5

| | Magnet Shape | Magnet Size [mm] | | Magnet Composition [vol %] | | Magnetic Energy Product (BH)max [MGOe] | Density ρ [g/cm$^3$] | Void [vol %] | Appearance | Mechanical Strength [kgf/mm$^2$] | Corrosion Resistance |
|---|---|---|---|---|---|---|---|---|---|---|---|
| Example 6 | Plate | Width: | 8 | Magnetic powder (5): | 81.5 | 18.8 | 6.34 | 1.5 | Good | 7.1 | ○ |
| | | Thickness: | 1 | Polyamide: | 9.4 | | | | | | |
| | | Length: | 10 | Antioxidant: | about 5 | | | | | | |
| | | | | Lubricant.Plasticizer: | trace | | | | | | |

TABLE 5-continued

| | Magnet Shape | Magnet Size [mm] | | Magnet Composition [vol %] | | Magnetic Energy Product (BH)max [MGOe] | Density ρ [g/cm³] | Void [vol %] | Appearance | Mechanical Strength [kgf/mm²] | Corrosion Resistance |
|---|---|---|---|---|---|---|---|---|---|---|---|
| Example 7 | Plate | Width: | 8 | Magnetic powder (4): | 60 | 19.5 | 7.11 | 1.0 | Good | 7.0 | ○ |
| | | Thickness: | 1 | Magnetic powder (5): | 23 | | | | | | |
| | | Length: | 10 | Polyamide: | 9.5 | | | | | | |
| | | | | Antioxidant: | about 5 | | | | | | |
| | | | | Lubricant.Plasticizer: | trace | | | | | | |
| Example 8 | Hollow cylinder | Outer diameter: | 18 | Magnetic powder (2): | 81 | 12.2 | 6.39 | 1.5 | Good | 8.2 | ⊙ |
| | | | | Liquid crystal polymer: | 12.5 | | | | | | |
| | | Wall thickness: | 0.7 | Antioxidant: | about 5 | | | | | | |
| | | | | Lubricant: | trace | | | | | | |
| | | Length: | 8 | | | | | | | | |
| Example 9 | Plate | Width: | 8 | Magnetic powder (4): | 41 | 19.0 | 6.80 | 1.1 | Good | 8.6 | ○ |
| | | Thickness: | 1 | Magnetic powder (6): | 40 | | | | | | |
| | | Length: | 10 | Polyamide: | 12 | | | | | | |
| | | | | Antioxidant: | about 5 | | | | | | |
| | | | | Lubricant: | trace | | | | | | |
| Example 10 | Hollow cylinder | Outer diameter: | 18 | Magnetic powder (3): | 82 | 12.9 | 6.42 | 1.5 | Good | 9.0 | ○ |
| | | | | PPS: | 10 | | | | | | |
| | | Wall thickness: | 0.7 | Antioxidant: | about 6 | | | | | | |
| | | | | Lubricant.Plasticizer: | trace | | | | | | |
| | | Length: | 8 | | | | | | | | |

To be continued on Table 6

TABLE 6

| | Magnet Shape | Magnet Size [mm] | | Magnet Composition [vol %] | | Magnetic Energy Product (BH)max [MGOe] | Density ρ [g/cm³] | Void [vol %] | Appearance | Mechanical Strength [kgf/mm²] | Corrosion Resistance |
|---|---|---|---|---|---|---|---|---|---|---|---|
| Example 11 | Plate | Width: | 8 | Magnetic powder (4): | 41 | 19.2 | 6.83 | 1.2 | Good | 9.3 | ○ |
| | | Thickness: | 1 | Magnetic powder (5): | 21 | | | | | | |
| | | Length: | 10 | Magnetic powder (6): | 20 | | | | | | |
| | | | | PPS: | 11 | | | | | | |
| | | | | Antioxidant: | about 4 | | | | | | |
| | | | | Lubricant: | trace | | | | | | |
| Example 12 | Plate | Width: | 8 | Magnetic powder (4): | 43 | 19.4 | 6.79 | 1.3 | Good | 8.6 | ○ |
| | | Thickness: | 1 | Magnetic powder (5): | 20 | | | | | | |
| | | Length: | 10 | Magnetic powder (6): | 20 | | | | | | |
| | | | | Liquid crystal polymer: | 9 | | | | | | |
| | | | | Antioxidant: | about 6 | | | | | | |
| | | | | Lubricant: | trace | | | | | | |
| Example 13 | Hollow cylinder | Outer diameter: | 18 | Magnetic powder (1): | 62 | 13.1 | 6.42 | 1.3 | Good | 6.3 | ○ |
| | | | | Magnetic powder (7): | 21 | | | | | | |
| | | Wall thickness: | 0.7 | Polyamide: | 8.5 | | | | | | |
| | | | | Antioxidant: | 5 | | | | | | |
| | | Length: | 8 | Lubricant.Plasticizer: | Slight | | | | | | |
| Comparative Example 1 | Rod | — | | — | | | Not measured due to impossible kneading | | | | |
| Comparative Example 2 | Hollow cylinder | — | | — | | | Not measured due to impossible molding | | | | |
| Comparative Example 3 | Hollow cylinder | Outer diameter: | 18 | Magnetic powder (1): | 80 | Not measurable | — | 10 | Resin discharge on the magnet surface | — | X |
| | | Wall thickness: | 0.7 | Epoxy resin: | 10 | | | | | | |
| | | Length: | 8 | | | | | | | | |

Examples 14 to 26. and Comparative Examples 4 to 6

Seven kinds of rare earth magnet powders, (1) through (7), each having a composition set forth below, the three thermoplastic binder resins A, B and C set forth above, a hydrazine antioxidant or chelating agent, zinc stearate as a plasticizer and a silicone oil as a lubricant were mixed according to the formulations set forth in Table 7.

Each mixture was kneaded with a screw kneader under the conditions set forth in Tables 8 and 9, and the resulting rare earth magnetic composition (compound) was subjected to a molding process under the conditions set forth in Tables 8 and 9 to obtain a rare earth bonded magnet. The shape, size, composition, visual appearance, and various properties of each resulting magnet will be summarized in Tables 10 through 12.

Rare Earth Magnet Powders (1) Quenched $Nd_{12}Fe_{82}B_6$ powder (average diameter: 19 μm)

(2) Quenched $Nd_8Pr_4Fe_{82}B_6$ powder (average diameter: 18 μm)

(3) Quenched $Nd_{12}Fe_{78}Co_4B_6$ powder (average diameter: 20 μm)

(4) $Sm(Co_{0.604}Cu_{0.06}Fe_{0.32}Zr_{0.016})_{8.3}$ powder (average diameter: 22 μm)

(5) $Sm_2Fe_{17}N_3$ powder (average diameter: 2 μm)

(6) Anisotropic $Nd_{13}Fe_{69}Co_{11}B_6Ga_1$ powder by H.D.D.R. method (average diameter: 30 μm)

(7) Nano-crystalline $Nd_{5.5}Fe_{66}B_{18.5}Co_5Cr_5$ powder (average diameter: 15 μm)

Each mechanical strength in Tables 10 through 12 was determined by a shearing-by-punching method using a test piece of 15 mm in outside diameter and 3 mm in height, which was molded by an injection molding process under the conditions set forth in Tables 8 and 9, under a nonmagnetic field. The corrosion resistance was evaluated by the method identical to the above.

TABLE 7

| | Composition [vol %] | |
|---|---|---|
| Example 14 | Magnetic powder (1): | 67.6 |
| | Polyamide: | 32.4 |
| Example 15 | Magnetic powder (2): | 70 |
| | Polyamide: | 24 |
| | Antioxidant: | 6 |
| Example 16 | Magnetic powder (3): | 72 |
| | Polyamide: | 20 |
| | Antioxidant: | 6.5 |
| | Lubricant: | 1.5 |
| Example 17 | Magnetic powder (3): | 75 |
| | Polyamide: | 15.5 |
| | Antioxidant: | 7 |
| | Lubricant: | 1.8 |
| | Plasticizer: | 0.7 |
| Example 18 | Magnetic powder (4): | 75 |
| | Polyamide: | 18 |
| | Antioxidant: | 5 |
| | Lubricant: | 1.5 |
| | Plasticizer: | 0.5 |
| Example 19 | Magnetic powder (5): | 72 |
| | Polyamide: | 19 |
| | Antioxidant: | 6 |
| | Lubricant: | 2.0 |
| | Plasticizer: | 1.0 |
| Example 20 | Magnetic powder (4): | 57 |
| | Magnetic powder (5): | 18 |
| | Polyamide: | 17 |
| | Antioxidant: | 5.5 |

TABLE 7-continued

| | Composition [vol %] | |
|---|---|---|
| | Lubricant: | 1.8 |
| | Plasticizer: | 0.7 |
| Example 21 | Magnetic powder (2): | 70 |
| | Liquid crystal polymer: | 23.5 |
| | Antioxidant: | 5.5 |
| | Lubricant: | 1.0 |
| Example 22 | Magnetic powder (4): | 50 |
| | Magnetic powder (6): | 25 |
| | Polyamide: | 18 |
| | Antioxidant: | 6 |
| | Lubricant: | 1.0 |
| Example 23 | Magnetic powder (3): | 72 |
| | PPS | 18 |
| | Antioxidant: | 7.5 |
| | Lubricant: | 1.7 |
| | Plasticizer: | 0.8 |
| Example 24 | Magnetic powder (4): | 55 |
| | Magnetic powder (5): | 10 |
| | Magnetic powder (6): | 5 |
| | PPS: | 22.5 |
| | Antioxidant: | 7.5 |
| Example 25 | Magnetic powder (4): | 50 |
| | Magnetic powder (5): | 12 |
| | Magnetic powder (6): | 10 |
| | Liquid crystal polymer: | 19.5 |
| | Antioxidant: | 7.5 |
| | Plasticizer: | 1.0 |
| Example 26 | Magnetic powder (3): | 55 |
| | Magnetic powder (7): | 20 |
| | Polyamide: | 15.5 |
| | Antioxidant: | 7 |
| | Lubricant: | 1.8 |
| | Plasticizer: | 0.7 |
| Comparative Example 4 | Magnetic powder (1): | 80 |
| | Polyamide: | 20 |
| Comparative Example 5 | Magnetic powder (1): | 78 |
| | Polyamide: | 16 |
| | Antioxidant: | 6 |
| | Lubricant: | 1.0 |
| Comparative Example 6 | Magnetic powder (2): | 55 |
| | Polyamide: | 45 |

TABLE 8

| | Kneading Conditions | | Molding Conditions | | | | |
|---|---|---|---|---|---|---|---|
| | | | | Cylinder | Injection | Mold | Alignment |
| | Temperature [° C.] | Length* [cm] | Method | Temperature [° C.] | Pressure [kgf/cm²] | Temperature [° C.] | Field [kOe] |
| Example 14 | 230 | 20 | Injection | 260 | 50 | 90 | Under nonmagnetic field |
| Example 15 | 230 | 20 | Injection | 260 | 50 | 90 | Under nonmagnetic field |

TABLE 8-continued

| | Kneading Conditions | | Molding Conditions | | | | |
|---|---|---|---|---|---|---|---|
| | | | | Cylinder | Injection | Mold | Alignment |
| | Temperature [° C.] | Length* [cm] | Method | Temperature [° C.] | Pressure [kgf/cm$^2$] | Temperature [° C.] | Field [kOe] |
| Example 16 | 230 | 25 | Injection | 260 | 50 | 90 | Under nonmagnetic field |
| Example 17 | 230 | 30 | Injection | 260 | 60 | 90 | Under nonmagnetic field |
| Example 18 | 250 | 30 | Injection | 300 | 60 | 90 | 15 |
| Example 19 | 240 | 35 | Injection | 270 | 60 | 90 | 15 |
| Example 20 | 250 | 25 | Injection | 290 | 60 | 90 | 15 |
| Example 21 | 250 | 25 | Injection | 280 | 70 | 90 | 15 |

To be continued on Table 9

*: This value represents the intensity of kneading. (Total length of kneading disk sections in the kneader.)

20

TABLE 9

| | Kneading Conditions | | Molding Conditions | | | | |
|---|---|---|---|---|---|---|---|
| | | | | Cylinder | Injection | Mold | Alignment |
| | Temperature [° C.] | Length* [cm] | Method | Temperature [° C.] | Pressure [kgf/cm$^2$] | Temperature [° C.] | Field [kOe] |
| Example 22 | 240 | 25 | Injection | 290 | 60 | 90 | 18 |
| Example 23 | 300 | 30 | Injection | 320 | 80 | 90 | Under nonmagnetic field |
| Example 24 | 300 | 30 | Injection | 320 | 80 | 90 | 18 |
| Example 25 | 250 | 25 | Injection | 280 | 70 | 90 | 18 |
| Example 26 | 230 | 20 | Injection | 260 | 50 | 90 | Under nonmagnetic field |
| Comparative Example 4 | 230 | 30 | Injection | Impossible kneading | | | Under nonmagnetic field |
| Comparative Example 5 | 230 | 30 | Injection | Impossible molding | | | Under nonmagnetic field |
| Comparative Example 6 | 230 | 10 | Injection | 260 | 40 | 90 | Under nonmagnetic field |

*: This value represents the intensity of kneading. (Total length of kneading disk sections in the kneader.)

TABLE 10

| | Magnet Shape | Magnet Size [mm] | | Magnet Composition [vol %] | | Magnetic Energy Product (BH)max [MGOe] | Density ρ [g/cm$^3$] | Void [vol %] | Appearance | Mechanical Strength [kgf/mm$^2$] | Corrosion Resistance |
|---|---|---|---|---|---|---|---|---|---|---|---|
| Example 14 | Hollow cylinder | Outer diameter: | 20 | Magnetic powder (1): | 68 | 6.4 | 6.38 | 1.4 | Good | 6.6 | ○ |
| | | Wall thickness: | 1.0 | Polyamide: | 32 | | | | | | |
| | | Length: | 10 | | | | | | | | |
| Example 15 | Hollow cylinder | Outer diameter: | 20 | Magnetic powder (2): | 72 | 7.5 | 5.58 | 1.1 | Good | 7.8 | ⊙ |
| | | Wall thickness: | 1.0 | Polyamide: | 25 | | | | | | |
| | | Length: | 10 | Antioxidant: | about 2 | | | | | | |

TABLE 10-continued

| | Magnet Shape | Magnet Size [mm] | | Magnet Composition [vol %] | | Magnetic Energy Product (BH)max [MGOe] | Density ρ [g/cm$^3$] | Void [vol %] | Appearance | Mechanical Strength [kgf/mm$^2$] | Corrosion Resistance |
|---|---|---|---|---|---|---|---|---|---|---|---|
| Example 16 | Hollow cylinder | Outer diameter: | 20 | Magnetic powder (3): | 74 | 8.3 | 5.70 | 1.1 | Good | 7.4 | ⊙ |
| | | Wall thickness: | 1.0 | Polyamide: | 21 | | | | | | |
| | | Length: | 10 | Antioxidant: | about 4 | | | | | | |
| | | | | Lubricant: | trace | | | | | | |
| Example 17 | Hollow cylinder | Outer diameter: | 20 | Magnetic powder (3): | 77 | 9.0 | 5.87 | 1.2 | Good | 5.5 | ⊙ |
| | | Wall thickness: | 1.0 | Polyamide: | 16 | | | | | | |
| | | Length: | 10 | Antioxidant: | about 5 | | | | | | |
| | | | | Lubricant.Plasticizer: | trace | | | | | | |
| Example 18 | Rod | Outer diameter: | 15 | Magnetic powder (4): | 76 | 15.6 | 7.03 | 1.3 | Good | 5.7 | ○ |
| | | Length: | 10 | Polyamide: | 19 | | | | | | |
| | | | | Antioxidant: | about 3 | | | | | | |
| | | | | Lubricant.Plasticizer: | trace | | | | | | |

To be continued on Table 11

TABLE 11

| | Magnet Shape | Magnet Size [mm] | | Magnet Composition [vol %] | | Magnetic Energy Product (BH)max [MGOe] | Density ρ [g/cm$^3$] | Void [vol %] | Appearance | Mechanical Strength [kgf/mm$^2$] | Corrosion Resistance |
|---|---|---|---|---|---|---|---|---|---|---|---|
| Example 19 | Rod | Outer diameter: | 15 | Magnetic powder (5): | 73 | 14.8 | 5.75 | 1.2 | Good | 5.2 | ○ |
| | | Length: | 10 | Polyamide: | 20 | | | | | | |
| | | | | Antioxidant: | about 4 | | | | | | |
| | | | | Lubricant.Plasticizer: | trace | | | | | | |
| Example 20 | Rod | Outer diameter: | 15 | Magnetic powder (4): | 58 | 16.2 | 7.06 | 1.1 | Good | 5.0 | ⊙ |
| | | Length: | 10 | Magnetic powder (5): | 19 | | | | | | |
| | | | | Polyamide: | 18 | | | | | | |
| | | | | Antioxidant: | about 3 | | | | | | |
| | | | | Lubricant.Plasticizer: | trace | | | | | | |
| Example 21 | Rod | Outer diameter: | 15 | Magnetic powder (2): | 72 | 7.3 | 5.61 | 1.2 | Good | 8.1 | ○ |
| | | Length: | 10 | Liquid Crystal polymer: | 24 | | | | | | |
| | | | | Antioxidant: | about 3 | | | | | | |
| | | | | Lubricant: | trace | | | | | | |
| Example 22 | Rod | Outer diameter: | 15 | Magnetic powder (4): | 51 | 15.6 | 6.99 | 1.3 | Good | 8.0 | ○ |
| | | Length: | 10 | Magnetic powder (6): | 26 | | | | | | |
| | | | | Polyamide: | 18.5 | | | | | | |
| | | | | Antioxidant: | about 3.5 | | | | | | |
| | | | | Lubricant: | trace | | | | | | |
| Example 23 | Hollow cylinder | Outer diameter: | 20 | Magnetic powder (3): | 73 | 7.9 | 5.73 | 1.2 | Good | 8.2 | ○ |
| | | Wall thickness: | 1.0 | PPS: | 18 | | | | | | |
| | | Length: | 10 | Antioxidant: | about 5 | | | | | | |
| | | | | Lubricant.Plasticizer: | trace | | | | | | |

To be continued on Table 12

TABLE 12

| | Magnet Shape | Magnet Size [mm] | | Magnet Composition [vol %] | | Magnetic Energy Product (BH)max [MGOe] | Density ρ [g/cm$^3$] | Void [vol %] | Appearance | Mechanical Strength [kgf/mm$^2$] | Corrosion Resistance |
|---|---|---|---|---|---|---|---|---|---|---|---|
| Example 24 | Rod | Outer diameter: | 15 | Magnetic powder (4): | 56 | 13.4 | 6.86 | 1.1 | Good | 8.3 | ○ |
| | | Length: | 10 | Magnetic powder (5): | 11 | | | | | | |
| | | | | Magnetic powder (6): | 5 | | | | | | |
| | | | | PPS: | 22 | | | | | | |
| | | | | Antioxidant: | about 5 | | | | | | |

TABLE 12-continued

| | Magnet Shape | Magnet Size [mm] | | Magnet Composition [vol %] | | Magnetic Energy Product (BH)max [MGOe] | Density ρ [g/cm³] | Void [vol %] | Appearance | Mechanical Strength [kgf/mm²] | Corrosion Resistance |
|---|---|---|---|---|---|---|---|---|---|---|---|
| Example 25 | Rod | Outer diameter: | 15 | Magnetic powder (4): | 51 | 14.1 | 6.82 | 1.2 | Good | 6.0 | ○ |
| | | | | Magnetic powder (5): | 12 | | | | | | |
| | | Length: | 10 | Magnetic powder (6): | 11 | | | | | | |
| | | | | Liquid crystal polymer: | 20 | | | | | | |
| | | | | Antioxidant: | about 5 | | | | | | |
| | | | | Plasticizer: | trace | | | | | | |
| Example 26 | Hollow cylinder | Outer diameter: | 20 | Magnetic powder (3): | 57 | 8.3 | 5.81 | 1.2 | Good | 5.6 | ○ |
| | | | | Magnetic powder (7): | 20 | | | | | | |
| | | Wall thickness: | 1.0 | Polyamide: | 16 | | | | | | |
| | | | | Antioxidant: | 5 | | | | | | |
| | | Length: | 10 | Lubricant.Plasticizer: | trace | | | | | | |
| Comparative Example 1 | Rod | — | | — | | | Not measured due to impossible molding | | | | |
| Comparative Example 2 | Hollow cylinder | — | | — | | | Not measured due to impossible molding | | | | |
| Comparative Example 3 | Hollow cylinder | Outer diameter: | 20 | Magnetic powder (1): | 55 | 4.5 | 4.72 | 1.0 | Good | 4.3 | Δ |
| | | | | Polyamide: | 44 | | | | | | |
| | | Wall thickness: | 1.0 | | | | | | | | |
| | | Length: | 10 | | | | | | | | |

Results set forth above will be reviewed.

As shown in Tables 4 through 6 and 10 through 12, rare earth bonded magnets of EXAMPLES 1 through 26 showed excellent moldability, a small void ratio, a high mechanical strength, magnetic properties such as magnetic energy product, and high corrosion resistance.

In contrast, in rare earth bonded magnets of COMPARATIVE EXAMPLES 1 and 4, the respective rare earth magnetic compositions were not able to be kneaded because of excessive rare earth magnet powder contents.

In COMPARATIVE EXAMPLES 2 and 5, each rare earth magnetic composition was not able to be molded because of an excessive rare earth magnet powder content, although kneading was successfully carried out.

In COMPARATIVE EXAMPLE 3, the resin discharged on the surface of the magnet.

In COMPARATIVE EXAMPLE 6, the rare earth bonded magnet showed a poor magnetic energy product because of an extremely small amount of the rare earth magnet powder, although molding was successfully carried out.

As set forth above, a rare earth bonded magnet in accordance with the present invention showing excellent moldability, high corrosion resistance and mechanical strength, and excellent magnetic properties at a minimum binder resin content can be provided, while utilizing advantages of the extrusion molding process, i.e., high versatility of magnet shape and size, high size precision, and high productivity suitable for mass production.

Further, a rare earth bonded magnet in accordance with the present invention showing excellent moldability, high corrosion resistance and mechanical strength, and excellent magnetic properties at a minimum binder resin content can be provided, while utilizing advantages of the extrusion molding process, i.e., high versatility of magnet shape and size, high dimensional precision, and a short molding cycle.

What is claimed is:

1. A rare earth bonded magnet produced from a rare earth magnetic composition comprising a rare earth magnet powder, a thermoplastic resin and a chelating agent for preventing oxidation of said rare earth magnet powder and said thermoplastic resin by extrusion molding, wherein the content of the rare earth magnet powder in the rare earth bonded magnet ranges from 78.1 to 83 percent by volume and said rare earth bonded magnet has a void ratio of 2 percent by volume or less thereby yielding a high magnetic energy product having excellent fluidity during extrusion molding such that a variety of different shaped and sized magnets may be formed, said rare earth magnet powder selected from the group consisting of:

a first composition comprising (1) R wherein R is at least one rare earth element including Y, (2) transition metals including Fe as the main ingredient, and (3) B; and a second composition comprising rare earth elements containing Sm as the main ingredient, transition metals including Fe as the main ingredient, and interstitial elements containing N as the main ingredient.

2. A rare earth bonded magnet according to claim 1, wherein said thermoplastic resin has a melting point of 400° C. or less.

3. A rare earth bonded magnet according to claim 1, wherein said thermoplastic resin is a resin selected from the group consisting of polyamide resins, liquid crystal polymers, and polyphenylene sulfide resins.

4. A rare earth bonded magnet according to claim 1, wherein said rare earth magnet powder comprises at least two rare earth magnet powders having different compositions or different average particle diameters.

5. A rare earth bonded magnet according to claim 1, wherein said rare earth bonded magnet has been molded in the absence of a magnetic field such that said magnet has a magnetic energy product $(BH)_{max}$ of 8 MGOe or more.

6. A rare earth bonded magnet according to claim 1, wherein said rare earth bonded magnet has been molded in the presence of a magnetic field such that said magnet has a magnetic energy product $(BH)_{max}$ of 12 MGOe or more.

7. A rare earth bonded magnet produced from a rare earth magnetic composition comprising a rare earth magnet powder, a thermoplastic resin and a chelating agent for preventing oxidation of said rare earth magnet powder and said thermoplastic resin by injection molding, wherein the content of the rare earth magnet powder in the rare earth bonded magnet ranges from 68 to 76 percent by volume and said rare earth bonded magnet has a void ratio of 2 percent by volume or less thereby yielding a high magnetic energy product having excellent fluidity during injection molding such that a variety of different shaped and sized magnets may be formed, said rare earth magnet powder selected from the group consisting of:

a first composition comprising (1) R wherein R is at least one rare earth element including Y, (2) transition metals including Fe as the main ingredient, and (3) B; and a second composition comprising rare earth elements containing Sm as the main ingredient, transition metals including Fe as the main ingredient, and interstitial elements containing N as the main ingredient.

8. A rare earth bonded magnet according to claim 7, wherein said thermoplastic resin has a melting point of 400° C. or less.

9. A rare earth bonded magnet according to claim 7, wherein said thermoplastic resin is a resin selected from the group consisting of polyamide resins, liquid crystal polymers, and polyphenylene sulfide resins.

10. A rare earth bonded magnet according to claim 7, wherein said rare earth magnet powder comprises at least two rare earth magnet powders having different compositions and/or different average particle diameters.

11. A rare earth bonded magnet according to claim 7, wherein said rare earth bonded magnet has been molded in the absence of a magnetic field such that said magnet has a magnetic energy product $(BH)_{max}$ of 6 MGOe or more.

12. A rare earth bonded magnet according to claim 7, wherein said rare earth bonded magnet has been molded in the presence of a magnetic field such that said magnet has a magnetic energy product $(BH)_{max}$ of 10 MGOe or more.

13. A rare earth magnetic composition used for extrusion molding comprising a rare earth magnet powder, a thermoplastic resin and a chelating agent for preventing oxidation of said rare earth magnet powder and said thermoplastic resin, wherein the content of said rare earth magnet powder ranges from 77.6 to 82.5 percent by volume in said rare earth magnetic composition such that said composition has excellent fluidity during extrusion molding thereby permitting a variety of different shaped and sized isotropic magnets to be made having high magnetic energy, said rare earth magnet powder selected from the group consisting of:

a first composition comprising (1) R wherein R is at least one rare earth element including Y, (2) transition metals including Fe as the main ingredient, and (3) B; and a second composition comprising rare earth elements containing Sm as the main ingredient, transition metals including Fe as the main ingredient, and interstitial elements containing N as the main ingredient.

14. A rare earth magnetic composition according to claim 13, wherein the content of said chelating agent ranges from about 2.0 to 12.0 percent by volume in the rare earth magnetic composition.

15. A rare earth magnetic composition according to claim 13, wherein said rare earth magnetic composition further comprises at least one of a plasticizer and a lubricant.

16. A rare earth magnetic composition used for extrusion molding comprising a rare earth magnet powder, a thermoplastic resin and a chelating agent for preventing oxidation of said rare earth magnet powder and said thermoplastic resin, wherein the total content of said thermoplastic resin and said chelating agent ranges from 15.0 to 22.4 percent by volume in said rare earth magnetic composition such that said composition has excellent fluidity during extrusion molding thereby permitting a variety of different shaped and sized isotropic magnets to be made having high magnetic energy, said rare earth magnet powder selected from the group consisting of:

a first composition comprising (1) R wherein R is at least one rare earth element including Y, (2) transition metals including Fe as the main ingredient, and (3) B; and a second composition comprising rare earth elements containing Sm as the main ingredient, transition metals including Fe as the main ingredient, and interstitial elements containing N as the main ingredient.

17. A rare earth magnetic composition according to claim 16, wherein said chelating agent content ranges from 2.0 to 12.0 percent by volume.

18. A rare earth magnetic composition used for injection molding comprising a rare earth magnet powder, a thermoplastic resin and a chelating agent for preventing oxidation of said rare earth magnet powder and said thermoplastic resin, wherein the content of said rare earth magnet powder in said rare earth bonded magnet ranges from 67.6 to 75.5 percent by volume such that said composition has excellent fluidity during injection molding thereby permitting a variety of different shaped and sized isotropic magnets to be made having high magnetic energy, said rare earth magnet powder selected from the group consisting of:

a first composition comprising (1) R wherein R is at least one rare earth element including Y, (2) transition metals including Fe as the main ingredient, and (3) B; and a second composition comprising rare earth elements containing Sm as the main ingredient, transition metals including Fe as the main ingredient, and interstitial elements containing N as the main ingredient.

19. A rare earth magenetic composition according to claim 18, wherein the content of said chelating agent ranges from about 2.0 to 12.0 percent by volume in the rare earth magnetic composition.

20. A rare earth magnetic composition according to claim 18, wherein said rare earth magnetic composition further comprises at least one of a plasticzer and a lubricant.

21. A rare earth magnetic composition used for injection molding comprising a rare earth magnet powder, a thermoplastic resin, and a chelating agent for preventing oxidation of said rare earth magnet powder and said thermoplastic resin, wherein the total content of said thermoplastic resin and said chelating agent in said rare earth bonded magnet ranges from 24.5 to 32.4 percent by volume such that said composition has excellent fluidity during injection molding thereby permitting a variety of different shaped and sized isotropic magnets to be made having high magnetic energy, said rare earth magnet powder selected from the group consisting of:

a first composition comprising (1) R wherein R is at least one rare earth element including Y, (2) transition metals including Fe as the main ingredient, and (3) B; and a second composition comprising rare earth elements containing Sm as the main ingredient, transition metals including Fe as the main ingredient, and interstitial elements containing N as the main ingredient.

22. A rare earth magnetic composition according to claim 21, wherein said chelating agent content ranges from 2.0 to 12.0 percent by volume.

* * * * *

UNITED STATES PATENT AND TRADEMARK OFFICE

CERTIFICATE OF CORRECTION

PATENT NO. : 6,143,193
DATED : November 7, 2000
INVENTOR(S) : Koji Akioka et al.

It is certified that error appears in the above-identified patent and that said Letters Patent is hereby corrected as shown below:

Title page,
Item [56], References Cited: add all art listed,

| | | |
|---|---|---|
| -- 5,643,491 | 7/1997 | Honkura et al |
| 5,350,558 | 9/1994 | Kawato et al |
| 4,983,232 | 1/1991 | Endoh et al -- |

Column 5,
Line 36, "represent" should be -- represents --.

Column 9,
Line 37, after "must" insert -- be --.

Column 10,
Line 18, "enhances" should be -- enhanced --.

Column 11,
Line 4, "a" (second occurrence) should be -- an --.

Column 17,
Line 60, delete the period after "26".

Signed and Sealed this

Fifth Day of February, 2002

*Attest:*

*Attesting Officer*

JAMES E. ROGAN
*Director of the United States Patent and Trademark Office*